US005253812A

United States Patent [19]

Staples et al.

[11] Patent Number: 5,253,812

[45] Date of Patent: Oct. 19, 1993

[54] TANK CLEANING METHOD AND APPARATUS

[76] Inventors: Wesley Staples, Rte. 3, Box 1512; Russell Staples, Rte. 5, Box 8082, both of Palatka, Fla. 32177

[21] Appl. No.: 961,823

[22] Filed: Oct. 16, 1992

[51] Int. Cl.[5] ..... B02C 23/36

[52] U.S. Cl. ..... 241/21; 241/46.17; 366/270

[58] Field of Search ..... 241/21, 46.017, 46.17, 241/185.6, 278.1, 24; 366/270

[56] References Cited

U.S. PATENT DOCUMENTS 1,485,205 2/1924 Sturtevant .
3,782,697 1/1974 Karg ..... 259/24
4,329,069 5/1982 Graham ..... 366/270
4,555,063 11/1985 Goettsch ..... 241/46.17
4,746,221 5/1988 Okumura et al. ..... 366/142

*Primary Examiner*—Douglas D. Watts
*Attorney, Agent, or Firm*—Kerkam, Stowell, Kondracki & Clarke

[57] ABSTRACT

A settling tank cleaning unit includes a vertically buoyant device, provided with means to generate both horizontal and vertical propulsion, thereby moving the device in a random pattern adjacent the bottom of a tank to be cleaned and, at the same time, cutting tank-deposited solids and transporting the solids to a solids and liquid mixing propeller which vertically lifts the mixture for recirculation or to a discharge zone.

14 Claims, 5 Drawing Sheets

FIG. 4
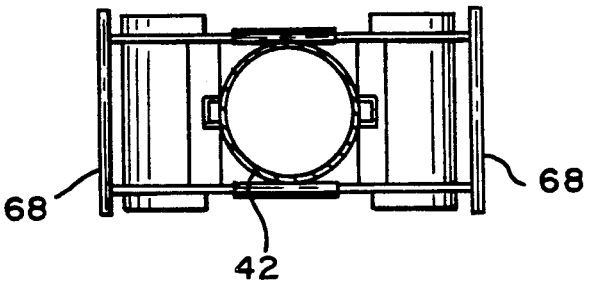
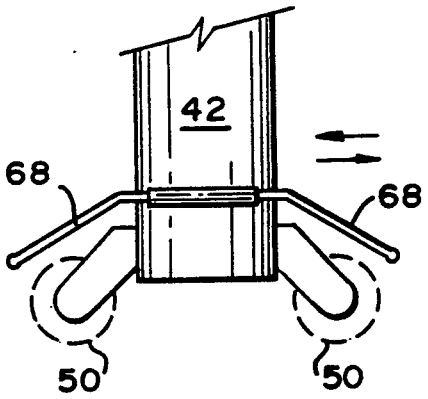
FIG. 5
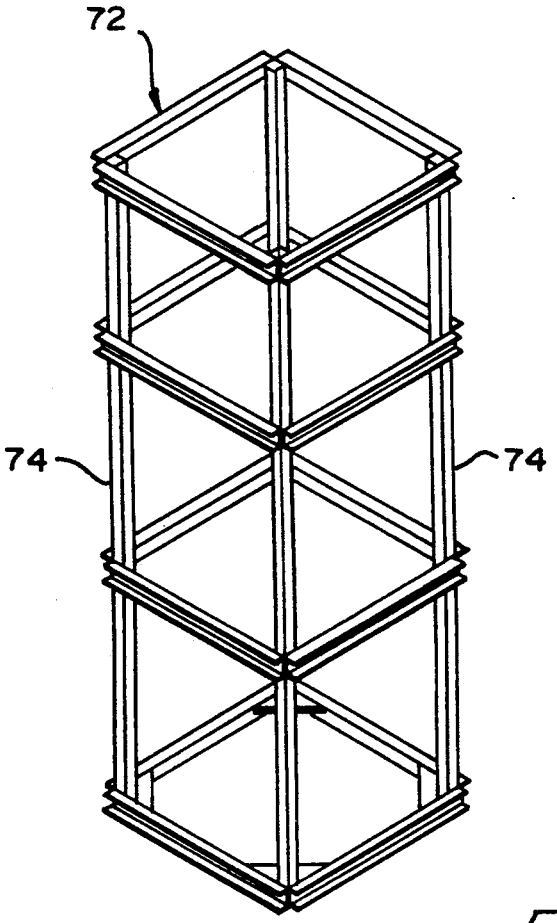
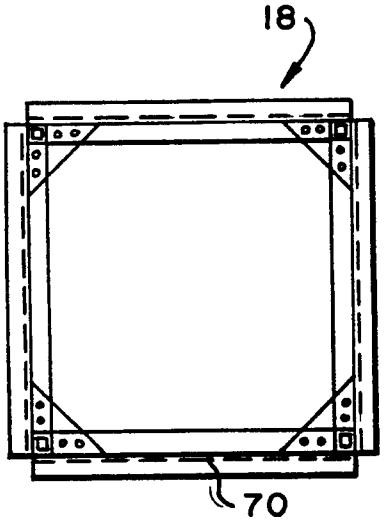
FIG. 7
FIG. 6

TANK CLEANING METHOD AND APPARATUS

BACKGROUND OF THE INVENTION

In the fields of high technology, heavy industrial and chemical processing, there exist a multitude of material handling problems. At times, some of these problems become so severe that they can shut down manufacturing components or entire units while the material handling units are cleaned. One such problem involves tank cleaning in a wide range of industries, such as pulp and paper industries, chemical industries, mining and refinery industries and steel industries. These problems exist when a liquid in a holding tank can no longer dissolve further solids, and the solids fall out or are precipitated and load the bottom of a holding or treating tank. Such fallout, in time, reduces tank capacity, stopping pumps, and, in some instances, locking in valuable capital cost of material. Many times, this problem develops before management is aware of the problem and tons of solids have been precipitated. Some of these tanks may be 40 feet high by 100 feet in diameter. This calls for very aggressive agitation to place the material in solution, or suspension, so as to remove the materials from the tank.

The following U.S. Pat. Nos. are representative of prior art tank stirring systems: 4,746,221, Okumura et al; 4,329,069, Graham; 3,782,697, Karg; and 1,485,205, Sturtevant.

SUMMARY OF THE INVENTION

This invention generally relates to a vertically buoyant device, provided with means to generate both horizontal and vertical propulsion, thereby moving the device in a random pattern adjacent the bottom of a tank and, at the same time, cutting tank-deposited solids and transporting the solids to a solids and liquid mixing propeller and vertically lifting the mixture to a discharge zone.

BRIEF DESCRIPTION OF THE DRAWINGS

FIG. 4 is a sectional view, on line 4—4, of FIG. 3;

FIG. 5 is a fragmentary view of the cutter end of the apparatus, illustrating the relationship between the cutter heads and bumpers;

FIG. 6 is a perspective view of a tower to be mounted on a top cover of a tank to be cleaned;

FIG. 7 illustrates a frame secured to the top cover of a tank to be cleaned;

DETAILED DESCRIPTION OF THE INVENTION

Figure 1:
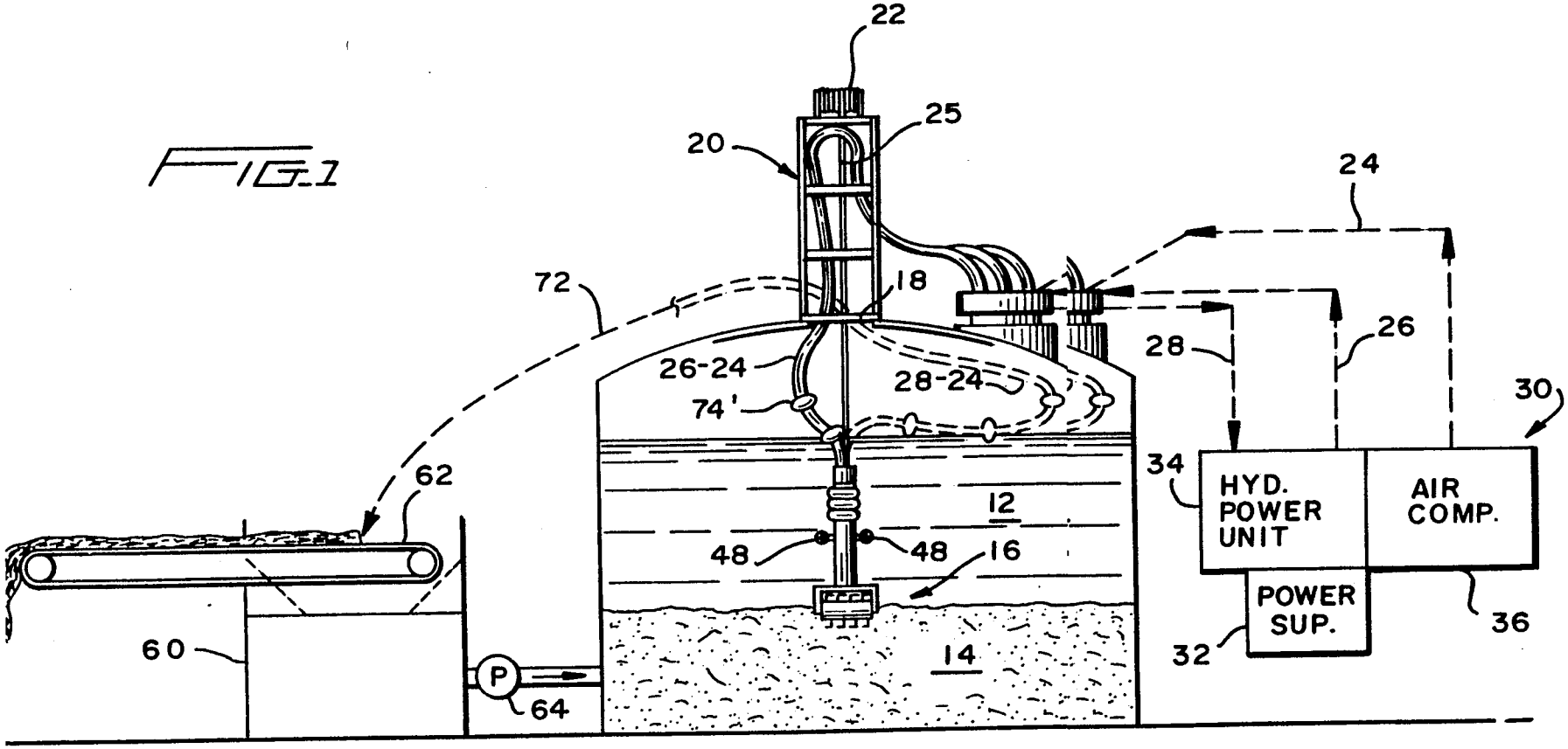
FIG. 1 is a diagrammatic view of a tank cleaning apparatus in association with a tank, a liquid/solid separator, and control means for a randomly mobile tank cleaner.

Referring to the drawings, and in particular FIG. 1 thereof, 10 designates a liquid/solid holding tank forming a part of a manufacturing or processing unit. The tank may be of substantially any configuration and, by way of example, tank 10 has a height of, for example, 40 feet and a diameter of 100 feet. The tank receives a liquid, designated 12, containing suspended or dissolved solids which, when the liquid 12 becomes saturated, sludge 14 settles or precipitates out of the liquid and falls to the bottom of the tank 10, as illustrated. In order to recover the values in the sludge, a cutting/elevating unit, generally designated 16, is placed in the tank via an opening, generally designated 18, formed in the top of the tank to which is connected a tower, generally designated 20. In an example, the tower may be 12 feet in height and, at the top, there is provided a winch 22 for a lift cable 25 attached to the top of the cutter/transporter unit.

The tower also feeds to the cutter/transporter unit 16 power lines which may consist of a compressed-air line 24 and pressure and return hydraulic lines 26, as at 28. Outside of the tank is the control unit, generally designated 30, which consists of a power supply 32, which drives a hydraulic pump contained in the hydraulic power unit 34 and drives an air compressor 36.

Figure 2:
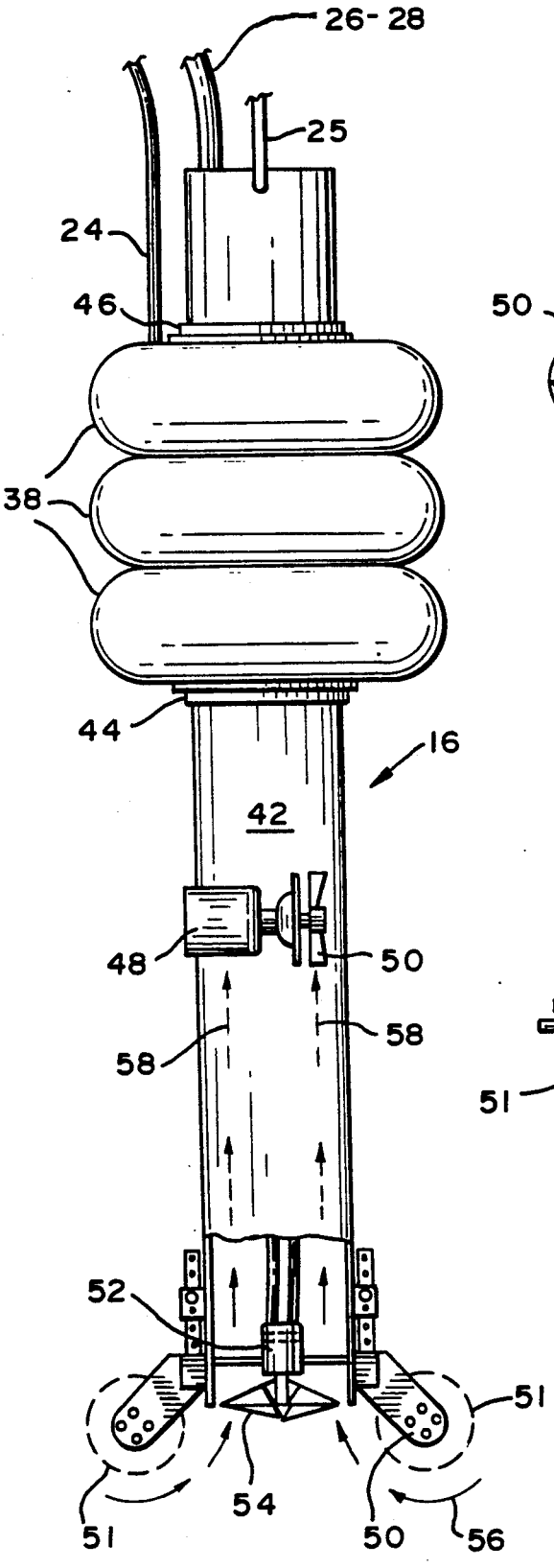
FIG. 2 is a vertical, partially sectional view of a dual cutter head tank cleaner.

The cutter/transporter unit 16 is best seen in FIG. 2, and the unit consists of floatation means, such as bladders 38, consisting of inflatable, generally toroidal, tubes which are connected to the source of compressed air via lines 24. Through the center of the floatation devices 38 is a tubular pipe having, for example, a diameter of approximately 12 inches and is designated 42. The floatation units are connected to the tube 42 as at retainers 44 at the bottom and 46 at the upper end.

The hollow tube 42 is connected to the lift cable 2 at its upper end, and passing internally through the tube 42 are the pressure and return hydraulic lines 26–28, which make connection to a pair of hydraulic motors 48, one on each side of the tube 42. The hydraulic motors are connected to propellers, such as propeller 50, FIG. 2 of the drawing. These hydraulic motors and propellers provide for steering of the cutter/transporter unit 16. By suitable valving, not shown, the pair of hydraulic motors and propellers can drive the unit either forward or backward or, by reversing one of the motors while the other is in a forward propulsion direction, the entire unit 16 may be rotated or turned about its axis.

The hydraulic lines also control motors 96 on each of the cutter heads 51 and a further hydraulic motor 52, having connected thereto a lift impeller 54. With the cutter heads rotating in the direction of directional arrows 56, FIG. 2 of the drawing, sludge cut by the cutter heads is directed upwardly toward the lifting motor 52 and impeller 54 so that a concentrated sludge flows upwardly through the tube 42, as shown by directional arrows 58. In its simplest form, the sludge flowing upwardly through the tube 42 discharges out of the top of the tube and, as the liquid is recirculated, will mix with the weaker liquid at the top of the tube. In a modification, a pump is mounted at the top of the tube 42 to discharge the unsolubilized materials and debris will be directed to a secondary tank 60, having at its top a conveyor screen 62 which removes solids and unsolubilized sludges while the liquid passes through the moving screen and is pumped via pump 64 back into the lower portion of the tank 10.

In a prototype construction, the cutter heads are 24 inches in diameter and are provided with a plurality of cutter bars 66, welded to the barrel portion of heads 51.

The length of the blades 66 from the barrel portion of the cutter head containing the hydraulic motor 96 would vary with the type of operation, such that if the cutter heads were functioning in loose sludge, a shorter blade could be used, whereas if the sludge had settled and compacted over a substantial period of time, or was gummy, a greater digging force would be required, and the cutter blades would be longer. Typically, the projection of the cutter blades from the surface of the barrel would be in the range of 3 inches to about 4 inches. Referring particularly to FIGS. 4 and 5, the device is provided with bumpers 68, which partially extend over the upper portion of the cutter heads. The bumpers prevent the cutters from engaging the wall of the tank and may be connected to valve means for reversing the direction of movement of the cutter/transporter unit. It is preferred to enter the tank 10 at the top center, so that the cutter/transporter unit can have uniform access around the tank; however, entry at the top side, if required, would be a possibility. This would require a longer power cable assembly.

Where there is no top center opening in the tank, a metal 30"×30" frame 70 is welded to the tank top, and the inside area is cut out, leaving an opening through which the equipment may enter the tank. The opening is illustrated in FIG. 7 and designated 18. To the frame 70 is bolted a tower, generally designated 20, formed of, for example, two inch by one inch by three-sixteenths inch channels 74. The tower 20 has a height of, for example, 12½ feet and carries at its top the winch 22 (FIG. 1), which has connected thereto the lift cable 25 for lowering the cutter/transporter unit into the tank and retrieving the unit. The top of the tank also has means for supporting the control cables for hydraulic fluid and compressed air. As shown in FIG. 1, the control cables 28–24 are provided with a plurality of floatation means 74' which maintain the slack portion of the cables on the surface of the liquid 12 and assist in preventing tangling of the cables during the random motion of the cutter/transporter unit. Where the cutter/transporter unit is to be provided with an auto-reverse, the bumpers 68 are mounted slightly above and ahead of each cutter head 51. The bumpers are connected to each other in a manner as to have one to two inches of travel back and forth. A small on/off hydraulic valve is connected to the bumper side supports in a manner as to be open in one direction and closed in the opposite direction of movement. A small hydraulic line is added to the power cable coming from the control bank 34 and tied to the primary on/off valve for the cutter heads. As the cutter/transporter unit moves to one side of the tank, and one of the bumpers 68 engages the side of the tank, it slides the bumper back, reversing the position on the small on/off valve, reversing the direction of movement of the two motors of the propulsion unit 48, thereby moving the unit in another direction in a random fashion.

OPERATIONAL DETAILS

Figure 8:
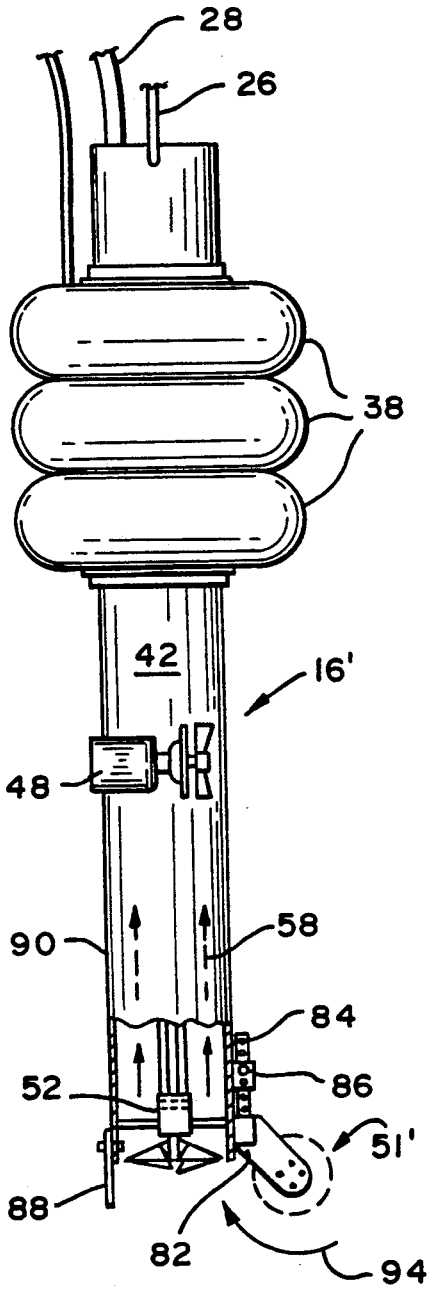
FIG. 8 is a view like FIG. 2, illustrating a single cutter head type of cleaning apparatus.
Figure 9:
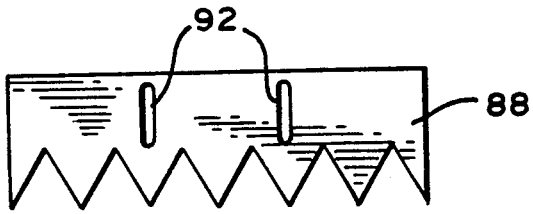
FIG. 9 is a front face view of an adjustable drag skirt.

Referring now to FIG. 8, a modified form of the present invention is illustrated, and like parts are designated with the same reference characters as in the primary form of the present invention.

Primarily, the FIG. 8 form of the invention differs from that in the preferred form in that only a single cutter head 51 is provided. The cutter head 51 includes tines, as in the previous form of the invention, and the cutter head is mounted from support brackets 82, which are, in turn, mounted to square tubing 84, adjustably mounted in brackets 86. On the opposite side 90 of the tubing 42 is mounted a drag skirt 88 which is adjustable in height via bolts fitted in adjustment slots 92. The function of the drag skirt is to correct for tilting of the unit. Thus, while operating in a tank with the cutter head rotating in the direction of directional arrow 94, the entire unit 16' is caused to angle or tilt, which causes the drag skirt to engage in the solids and retard forward motion of the unit. As the buoyancy at the top raises the tube into a more vertical angle, the drag skirt raises and allows the forward motion of the device to continue. The pair of steering propeller units 48 also assist in maintaining the entire cutter/transporter unit to maintain a desired, substantially vertical, alignment.

Figure 10:
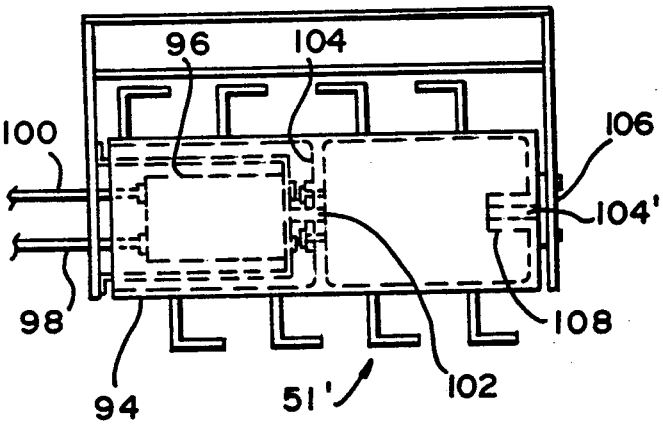
FIG. 10 is a view of a cutter head showing the hydraulic motor drive mechanism.

Referring now to FIG. 10, there are shown details of the drive and mounting of the cutter head(s) 51–51'. The cutter head 51 shown in FIG. 10 may be for the dual cutter head form of the invention or the single cutter head form shown in FIG. 8. Within the barrel portion 94 is mounted a reversible hydraulic motor 96, having hydraulic lines 98 and 100 connected thereto. The output shaft from the hydraulic motor 96, designated 102, is splined to drive a hub 104, which is bolted to the internal center plate. At the opposite end of the barrel portion of the cutter 51 is a stub shaft 104', which is carried by a stub shaft bushing 108, secured to end plate 106.

The general mode of operation of the cutter/transporter unit can be described as "free rein," much as the modern-day swimming pool cleaners go back and forth in random patterns. Once the inflation of the bladder and cutter head speeds are adjusted, the unit is not controlled by an operator in the early phase of tank cleanout. As the unit plows its way around the tank bottom, it will bring down the level of the solids buildup. Remaining pockets may be removed by directing the unit to those areas with the steering props.

The cutter/transporter unit not only removes heavy solids, but serves to de-stratify the solution into a uniform mixture. The heavy weight of the bottom and the buoyancy of the top, along with the down-draft caused by the lift propeller, yield excellent penetration of the tines of the cutter head into the solids in the tank. With the drag skirt moving up and down as the angle of the device varies, the cutter has ample time to cut through the solids in its path.

The advantages of the dual cutter head form of the invention over the single cutter head form are:

1. The added weight will cause the unit to be more aggressive in hard buildups.
2. It can also be used to retard the movement in one direction.
3. It will add vertical stability to the unit.
4. It will permit the use of auto reverse.
5. It will permit speed control, that is, the closer the cutter heads turn at the same speed, the slower the unit moves.

In the dual cutter head form of the invention, it is envisioned that the "front" cutter head (the direction of travel of the unit) will move at a speed of 100% of capacity and the "back" cutter head will operate at a speed of 20%–25% of capacity. The cutter heads turn in the same direction, going forward and backward, always moving material toward the lift prop. The slower-rotation cutter head is actually trying to propel the unit in the wrong direction. This all works very well with the "auto reverse" feature.

Another option available is extending the flow of materials from the vertical propeller (or impeller) by attaching a hose at the top of the vertical lift tube and with the help of an in-line pump (not shown), if necessary, to move the material from the tank. This material would flow into a power screen which would remove the solids to the extent the screen grid size would allow and load the solids into a dump truck, or the like. The liquid would flow through the screen and into a small holding tank, from which it would be pumped back into the large tank being cleaned. The volume of material which the lift prop will move is much greater than the volume which will be moved through the hose 72 leading out of the tank. For this reason, a screened window is located above the bladder on the lift tube to allow any surplus volume of liquid to escape; however, the solids would be retained in the flow. Although this would reduce the pressure at the top of the lift tube, it would bring the solids of the material being removed from the tank to a greater percentage, resulting in less handling.

Figure 3:
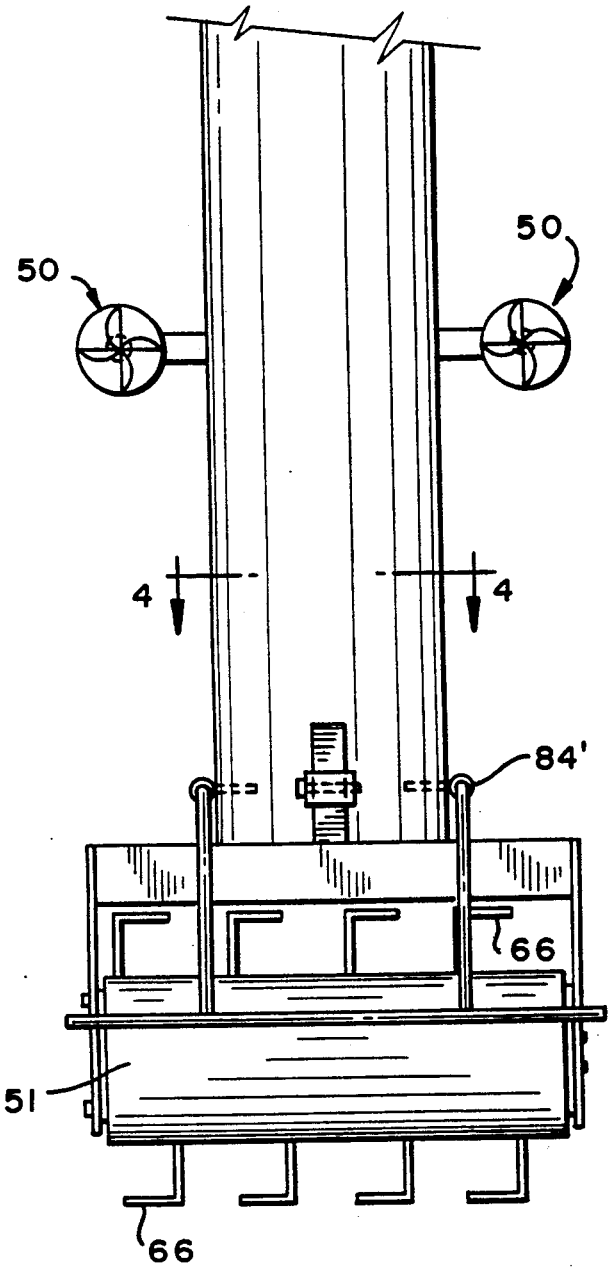
FIG. 3 is an enlarged, detailed view of the cutter head of the tank cleaner.

When using the "auto reverse" bumpers, FIGS. 3–5, upon reverse of the unit:

1. The speed of the cutter heads are switched, and
2. The direction of rotation of the steering props is reversed.

It should be noted that this is not a straight-forward and straight-backward operation. As the unit moves in a random fashion, as described, and by switching directions, the unit covers the entire tank area without constant operator oversight.

Figure 11:
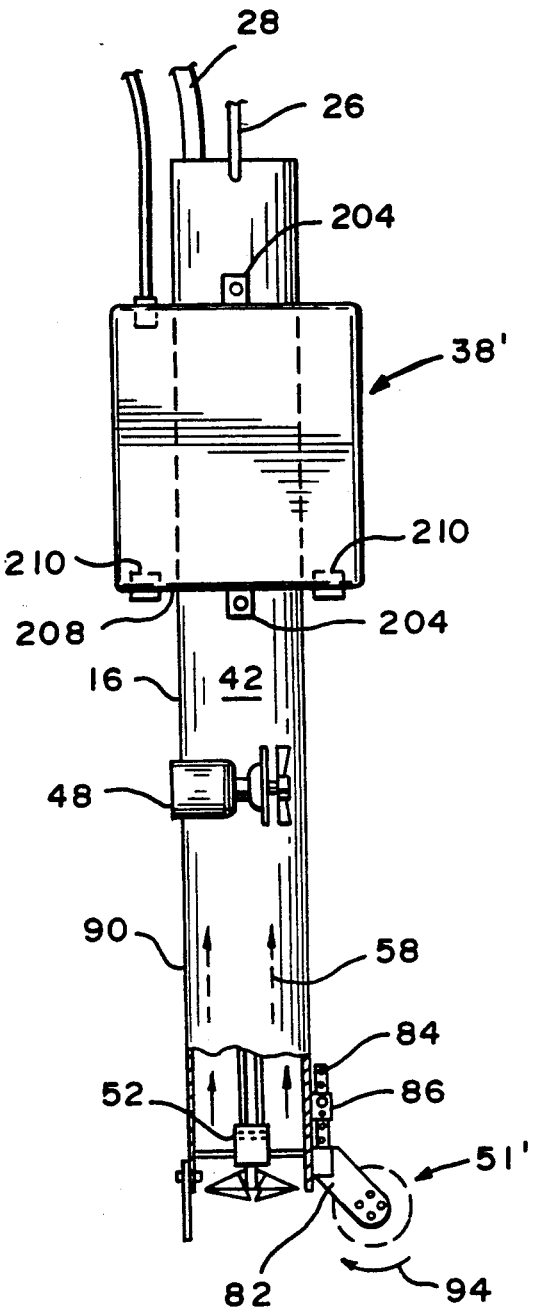
FIG. 11 is a modified form of the present invention, and the drawing is equivalent to that shown in FIG. 8.
Figure 12:
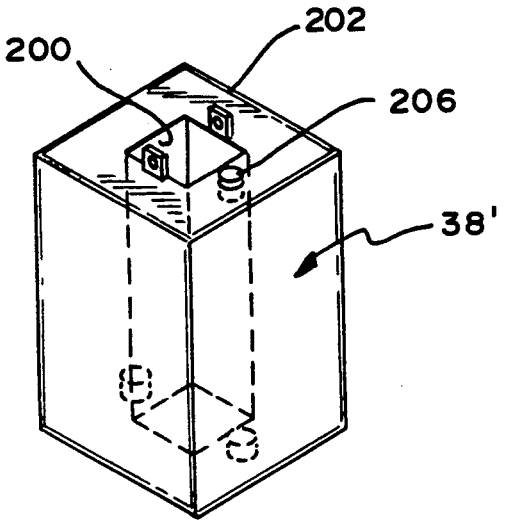
FIG. 12 is a perspective view of a metal floatation device, as employed in the FIG. 11 form of the invention.

A modified form of the present invention is illustrated in FIGS. 11 and 12. In FIGS. 11 and 12, the sludge cutting assembly has a metal floatation means 38'. The floatation means 38' comprises an elongated metal container which has an opening 200, extending from the top 202 centrally through the container 38'. The opening 200 is sized to receive the main cutter/transporter unit 16. Upper and lower tabs 204 attach the floatation unit 38' to the cutter/transporter unit 16. Attached to the top of the floatation unit 38' is a ferrule 206, through which compressed-air lines or hydraulic lines, such as 24–28, are secured. In the bottom of the tank 208 are a pair of ferrules 210 which communicate with the interior of the floatation means 38' and with the liquid in the tank containing the liquid to be dissolved or solubilized. In operation, compressed air is forced into the tank 38' via the air line, forcing fluid from the tank to control floation of the entire cutter/transporter unit. Where it is desired to lower the entire cutter/transporter unit 16 into the tank, compressed air is valved from the container 38', permitting liquid to fill the void, whereby the entire unit is lowered.

Figure 13:
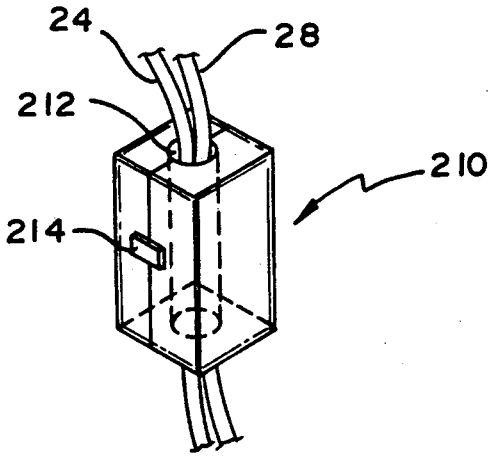
FIG. 13 is a view of a novel cable floatation means to prevent the power cables from being entangled in the steering propellers and/or the cutter heads.

In this form of the invention, an improved floatation means for the control cables, such as cables 24–28, is illustrated in FIG. 13, and designated 210. The unit 210 comprises a rectangular metal box, having welded in the central portion thereof a, for example, 3-inch pipe 212. The floatation unit 210 thus comprises two half units which are held together by tabs 214, which are either bolted or welded, as desired. In operation, the floation units 210 are generally placed about five feet apart and prevent entanglement of the control lines. Further, where desired, a further tank, similar in construction to the floatation means 210, is attached to the cables about, for example, 20 feet from the cutter/transporter unit to mark the position of the unit in, for example, a tank having a depth of about 25 feet. With this arrangmement, an operator can easily ascertain the position of the cutter/transporter unit 16.

We claim:

1. A tank-cleaning apparatus, comprising a vertically buoyant housing, at lest one cutter/transporter unit mounted at the lower end of the housing, drive means for the at least one cutter/transporter unit, separate drive means to generate horizontal and vertical propulsion of the housing to thereby move the housing in a random pattern adjacent the bottom of a tank and cutting tank-deposited solids and transporting the solids to a liquid mixing impeller, including further means for varying the buoyancy of the tank-cleaning apparatus, wherein the further means for varying the buoyancy of the tank-cleaning apparatus includes inflatable tubes carried adjacent the upper end of the housing and means for directing compressed air to and from said tubes.

2. The apparatus, as defined in claim 1, wherein the means for generating horizontal propulsion includes the at least one cutter transporter unit and a pair of propellers mounted to opposite sides of said housing and means for actuating the propeller, said last-named means including means for reversing the direction of rotation of the propellers.

3. Apparatus, as defined in claim 1, wherein the housing comprises a hollow tube and an impeller for directing solids and liquid from the at least one cutter/transporter unit vertically upward through the hollowing housing.

4. The tank-cleaning apparatus, as defined in claim 3, including a pair of cutter/transporter units on opposite sides of the hollow housing.

5. The tank-cleaning apparatus, as defined in claim 4, wherein the pair of cutter/transporter units are cutter heads which rotate in opposite directions to feed solids and liquids to the impeller.

6. The apparatus, as defined in claim 5, wherein the pair of cutter heads are actuated by hydraulic motors.

7. The tank-cleaning apparatus, as defined in claim 6, wherein the pair of hydraulic motors rotate the two cutter heads at different speeds.

8. The apparatus, as defined in claim 7, wherein one of the cutter heads is rotated at 100% of capacity and the other at 25% of capacity.

9. The apparatus, as defined in claim 5, wherein liquids and solids impelled through the hollow housing are directed to a liquid-solid separator connected externally of the tank to be cleaned.

10. The tank-cleaning apparatus, as defined in claim 9, wherein the separated liquid is recirculated to the tank to be cleaned.

11. The tank-cleaning apparatus, as defined in claim 1, further including a tower mounted to the top of the tank to be cleaned and winch means mounted at the top of the tower to raise and lower the tank-cleaning apparatus.

12. The tank-cleaning apparatus, as defined in claim 8, further including a bumper surrounding a portion of each cutter head and means associated with the bumper to reverse the direction of horizontal movement of the housing.

13. The tank-cleaning apparatus, as defined in claim 1, including one cutter/transporter unit and an adjustable drag skirt mounted on the side of the housing opposite to the position of mounting of the cutter/transporter unit.

14. A method of cleaning a tank containing liquid and bottom-deposited solids, the steps: lowering into a tank a vertically buoyant, hollow housing; attaching to the lower end of the housing at least one cutter/transporter unit; rotating the cutter/transporter unit to cut the tank bottom-deposited solids and to direct the solids and liquid vertically upward through the hollow housing, mounting a pair of steering propellers to the outside of the hollow housing, attaching buoyancy control means to the hollow housing, providing a power source for the at least one cutter/transporter and the steering propellers and providing compressed air for the buoyancy control means.

* * * * *